US005796172A

United States Patent [19]

Morisita et al.

[11] Patent Number: 5,796,172

[45] Date of Patent: Aug. 18, 1998

[54] STARTER APPARATUS WITH VARIABLE ANGLE MOUNTING

[75] Inventors: Akira Morisita; Keiichi Konishi; Kyohei Yamamoto, all of Tokyo, Japan

[73] Assignee: Mitsubishi Denki Kabushiki Kaisha, Tokyo, Japan

[21] Appl. No.: 756,639

[22] Filed: Nov. 26, 1996

[30] Foreign Application Priority Data

Jan. 8, 1996 [JP] Japan ..... 8-000787

[51] Int. Cl.[6] ..... F02N 11/00

[52] U.S. Cl. ..... 290/48; 290/38 R; 74/6

[58] Field of Search ..... 290/38 R, 38 A, 290/38 C, 48; 74/6, 7 R

[56] References Cited

U.S. PATENT DOCUMENTS

| | | | |
|---|---|---|---|
| 2,141,331 | 12/1938 | Allen | 290/48 |
| 4,855,609 | 8/1989 | Eguchi et al. | 290/48 |
| 4,918,324 | 4/1990 | Isozumi | 290/48 |
| 5,081,874 | 1/1992 | Izosumi | 74/7 A |
| 5,163,335 | 11/1992 | Isom et al. | 74/6 |
| 5,220,844 | 6/1993 | Mills | 74/6 |

FOREIGN PATENT DOCUMENTS

| | | |
|---|---|---|
| 334 140 | 4/1976 | Germany . |
| 195 15 582 | 11/1995 | Germany . |
| 56-23493 | 6/1981 | Japan . |
| 1-88071 | 6/1989 | Japan . |

*Primary Examiner*—Steven L. Stephan
*Assistant Examiner*—Nicholas Ponomarenko
*Attorney, Agent, or Firm*—Sughrue, Mion, Zinn, Macpeak & Seas, PLLC

[57] ABSTRACT

A starter apparatus comprises a mounting arrangement for an engine 16, an overhang type front housing 21, and a metal flange member 22 for mounting a starter main body. A sealing ring 23 and accommodating groove 22*c* are provided in the cast iron flange member, to avoid any weakening groove in the aluminum front housing. An excess number of screw holes 21*a*, 22*b* and 16*a* are provided in the front housing, the flange member and the engine to enable the mounting angle of the starter apparatus to be adapted to different engine requirements.

6 Claims, 5 Drawing Sheets

STARTER APPARATUS WITH VARIABLE ANGLE MOUNTING

BACKGROUND OF THE INVENTION

1. Field of the Invention

The present invention relates to a starter apparatus for an internal combustion engine.

2. Description of the Prior Art

Generally, mounting conditions for a starter apparatus of an engine, such as the distance between a mounting surface and a ring gear, the pitch and angle of mounting holes, the specifications of the ring gear, and so forth, depend on the engine. Thus, when another engine is used, a housing that satisfies the mounting conditions of the engine is required for the starter apparatus. In addition, to fabricate the new housing, a corresponding die is required.

For example, in the case of large Diesel engines, although there are many models, the number of engines fabricated for each type is small. When dedicated dies are used for starter apparatuses for such many-model, small-quantity engines, the cost performance deteriorates. To solve this problem, base portions of a housing are produced with a common die. Portions that differ in individual models are produced with dedicated dies. This method is called a variable mounting system.

FIG. 1 is a partial sectional view showing the structure of a conventional starter apparatus. In FIG. 1, reference numeral 1 is an electric motor, 1 a is a shaft of the motor, 2 is a planetary reduction gear mechanism, 3 is an output shaft connected to a planetary gear of the mechanism 2, and 4 is an overrunning clutch that is slideable on the output shaft. A clutch outer of the overrunning clutch 4 is helically splined with the output shaft 3. Reference numeral 5 is a pinion moving member disposed integrally with a clutch inner of the overrunning clutch 4, and it has a pinion 6 at one end. Reference numeral 7 is a ring gear of an engine, engageable with the pinion 6. Reference numeral 8 is a lever, whose one end is fitted to the overrunning clutch 4. Reference numeral 9 is a solenoid switch connected to the other end of the lever 8. When a coil is energized, the switch 9 pulls in the lever 8 to rotate it, and a main switch of the motor 1 is closed. Reference numeral 10 is a rear housing of the motor, 11 is a yoke mated with the rear housing, and 12 is an overhang type cast iron front housing that is mated with the yoke 11 and which houses the reduction gear mechanism 2, the output shaft 3, and the overrunning clutch 4.

Reference numeral 12*a* is a ring shaped groove formed on an outer peripheral portion of the front housing 12, and 12*b* is one of eight screw holes formed in the outer periphery of the front housing. Reference numeral 13 is an O ring disposed in the groove 12*a*, and 14 is a ball bearing disposed at the inner periphery of the front housing for slidably supporting the pinion moving member 5. Reference numeral 15 is a cast iron flange member having three holes 15*a* for mounting the starter assembly to a cylinder block 16, and holes 15*b* for mounting the front housing 12. There are sixteen housing mounting holes 15*b* on the same periphery to enable changing the mounting angle of the front housing 12. Reference numeral 16*a* is one of three screw holes formed in the cylinder block 16, and 16*b* is a chamfer for accommodating an O ring 17. Reference numeral 18 is one of four mounting screws that secure the flange member 15 to the front housing 12. Reference numeral 19 is one of three mounting screws that secure the flange member 15 to the cylinder block 16. Reference numeral 20 is a wet type clutch which transmits the rotation of a flywheel integrally formed with the ring gear 7 to a transmission and a wheel (not shown).

The starter main body is composed of the motor 1, the reduction gear mechanism 2, the output shaft 3, the overrunning clutch 4, the pinion moving member 5, the pinion 6, the lever 8, the switch 9, the rear housing 10, the yoke 11, the front housing 12, and the ball bearing 14.

The operation of the starter apparatus will not be described as it is conventional and well known, as disclosed, for example, in Japanese Utility Model Examined Publication No. 56-23493, Japanese Utility Model Laid-Open Publication No. 1-88071, and U.S. Pat. Nos. 4,918,324 and 5,220,844.

In the starter apparatus described above, the starter main body is mounted on the engine through the flange member 15. Thus, the housing mounting holes 15*b* of the flange members are selected so that the starter main body has a mounting angle corresponding to the mounting conditions or requirements of the engine. The selected mounting holes 15*b* and screw holes 12*b* of the front housing 12 are matched, and secured by the four mounting screws 18. Thereafter, the engine mounting holes 15*a* of the flange member 15 and the screw holes 16*a* of the cylinder block 16 are matched or aligned, and secured by the three mounting screws 19. By properly selecting the housing mounting holes 15*a* of the flange member 15, the mounting angle of the starter apparatus to the engine can be adjusted.

The starter apparatus described above structure is a wet type. For example, it is mounted on an engine with a wet type clutch 20. Oil of the clutch is splashed by the rotation of the ring gear 7, and tends to leak out through the connected surfaces of the flange member 15 and the cylinder block 16, and the flange member and the front housing 12. To prevent the clutch oil from leaking to the outside of the starter apparatus, the O ring 17 is disposed at the connected corners of the cylinder block 16 and the flanges member 15, and the O ring 13 is disposed between the flange member and the front housing 12 in the circular groove 12*a*.

However, if the front housing 12 for a wet type starter apparatus is used for a dry type starter apparatus for an engine with a dry clutch or the like, although the dry type apparatus does not require an O ring seal, since the groove 12*a* for accommodating the O ring 13 is already formed, the unnecessary cost is not avoided and the mechanical strength of the front housing 12 is weakened due to the presence of the groove. Thus, it is difficult to interchangeably use either a wet type or a dry type starter apparatus.

SUMMARY OF THE INVENTION

An object of the present invention is to provide a starter apparatus having a front housing that can be used in common with both a wet type starter apparatus and a dry type starter apparatus.

Another object of the present invention is to provide a starter apparatus that is used as a wet type starter apparatus and that enables the front housing to be lighter and yet have a satisfactory mechanical strength.

Still another object of the present invention is to provide a starter apparatus that is used as a wet type starter apparatus and which prevents engine oil from leaking out into the starter main body, and dust from entering the ball bearing.

To accomplish the above-described objects, a first aspect of the present invention is a starter apparatus comprising a mounting portion for an engine, a front housing, and a metal flange member for mounting a starter main body corresponding to the mounting conditions of the engine, the flange member having a mounting portion for mounting a seal member to the front housing. Since the flange member mounts or carries the seal, the front housing of the master main body can be used in common with a wet type starter apparatus and a dry type starter apparatus.

The front housing may be composed of an aluminum material, and the flange member composed of a cast iron material such that when the starter apparatus is used as a wet type starter apparatus, the front housing can be both light and have satisfactory mechanical strength.

A third aspect of the present invention is a starter apparatus comprising a front housing having a ball bearing or the like for slidably supporting an outer peripheral portion of a pinion moving member integrally formed with a clutch inner of an overrunning clutch, and an oil seal disposed adjacent to and in the axial direction of the bearing and connected to the outer peripheral portion of the pinion moving member. With this arrangement, when the starter apparatus is used as a wet type starter apparatus, the oil seal can securely prevent engine oil from leaking out to the starter main body and to the outside.

A further aspect of the present invention is a starter apparatus comprising a flange member having a mounting portion for mounting a seal member for sealing an engine. Since the front housing and the flange member are sealed, and the flange member and the engine are sealed, when the starter apparatus is used as a wet type starter apparatus, the engine oil is prevented from leaking out to the outside of the apparatus with a simple structure.

DETAILED DESCRIPTION OF THE PREFERRED EMBODIMENTS

First Embodiment

Figure 1:
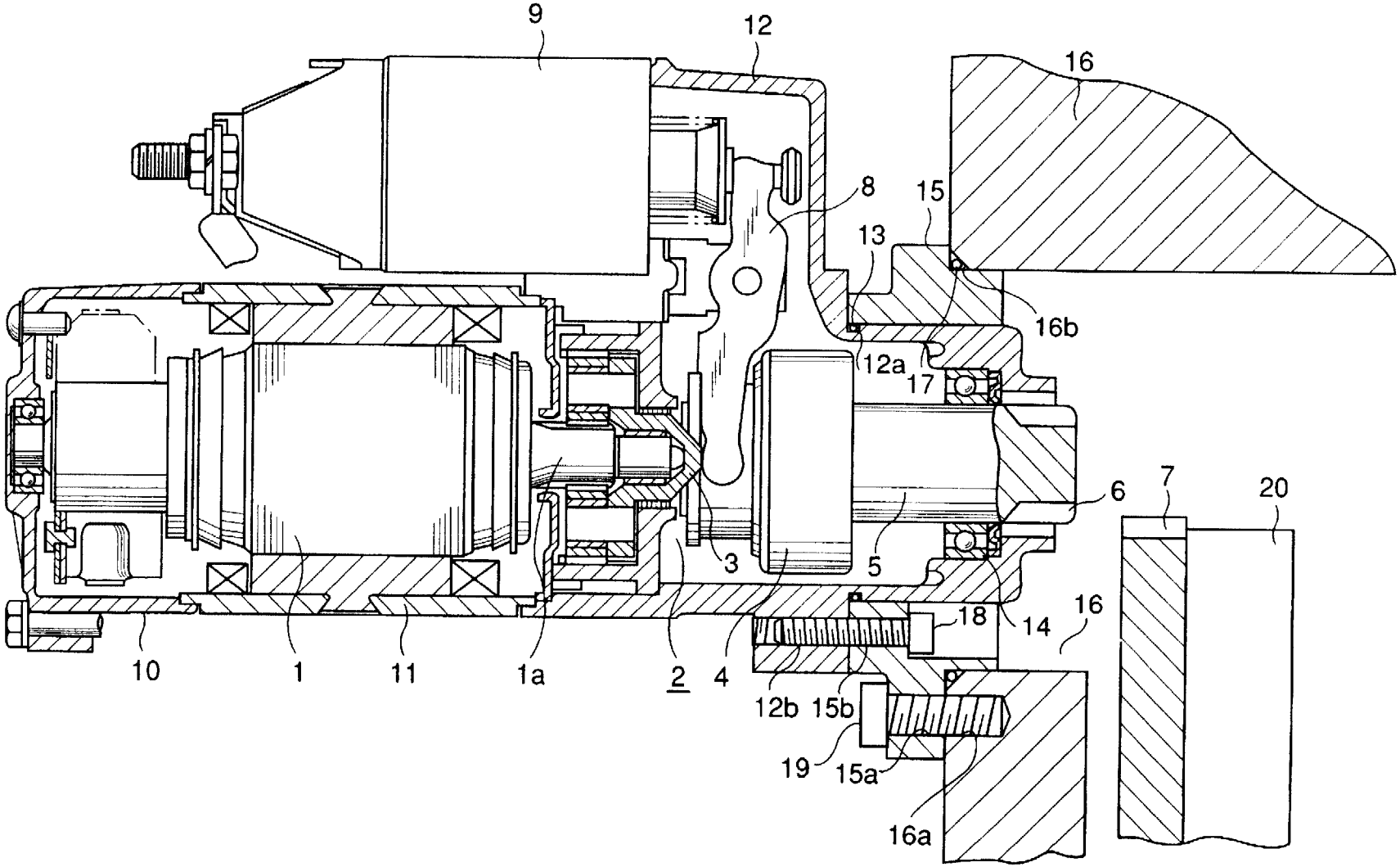
FIG.1 PRIOR ART
FIG. 1 is a partial sectional view showing a conventional starter apparatus.
Figure 2:
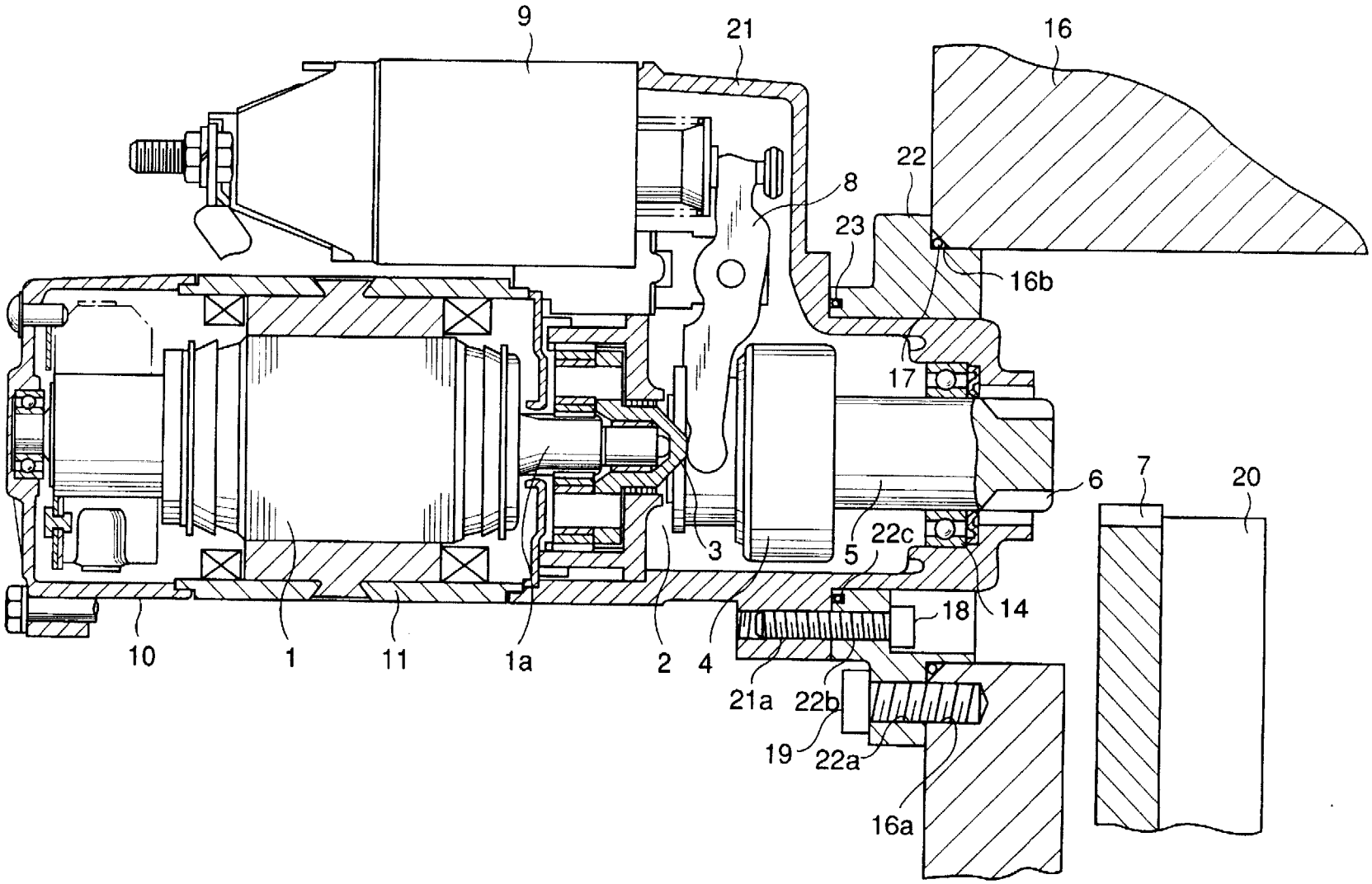
FIG. 2 is a partial sectional view showing a starter apparatus according to a first embodiment of the present invention.

With reference to FIG. 2, similar portions to those in FIG. 1 are denoted by similar reference numerals and their description is omitted. In FIG. 2, reference numeral 21 is an overhanging type front housing that is integrally formed of die cast aluminum. It houses a planetary reduction gear mechanism 2, an output shaft 3, an overrunning clutch 4, and a ball bearing 14. Reference numeral 21*a* is one of eight screw holes formed at an outer peripheral portion of the front housing 21. Reference numeral 22 is a cast iron flange member having three holes 22*a* for mounting to a cylinder block 16, and sixteen holes 22*b* for mounting to the front housing 21 such that the mounting angle of the front housing can be changed. Reference numeral 22*c* is a circular or ring shaped groove formed in an inner periphery of the flange member 22, and 23 is an O ring seal disposed in the groove 22*c*. The O ring is compressed against the outer peripheral surface of the front housing 21.

In such a starter apparatus, oil of a wet type clutch 20 is splashed by the rotation of the ring gear 7. The oil tends to leak out through the abutting surfaces of the flange member 22 and the cylinder block 16, and the flange member and the front housing 21. However, such oil leakage is prevented by the O ring 17 disposed at the mating corners of the cylinder block 16 and the flange member 22. In addition, any oil that leaks out from the O ring 17 is prevented from leaking further by the O ring 23 disposed in the groove 22*c* in the flange member.

Thus, the oil of the wet type clutch 20 hardly leaks out to the outside of the starter apparatus. Consequently, the level of the clutch oil can be prevented from decreasing. In addition, the other units are not adversely affected by the oil leakage.

Since the front housing 21 does not have a ring shaped groove for an o ring, the starter apparatus can be used in common for both a wet type starter and a dry type starter. Although the front housing 21 is composed of die cast aluminum, satisfactory mechanical strength can be obtained, and the starter apparatus is lighter than a starter apparatus composed of cast iron.

Second Embodiment

Figure 3:
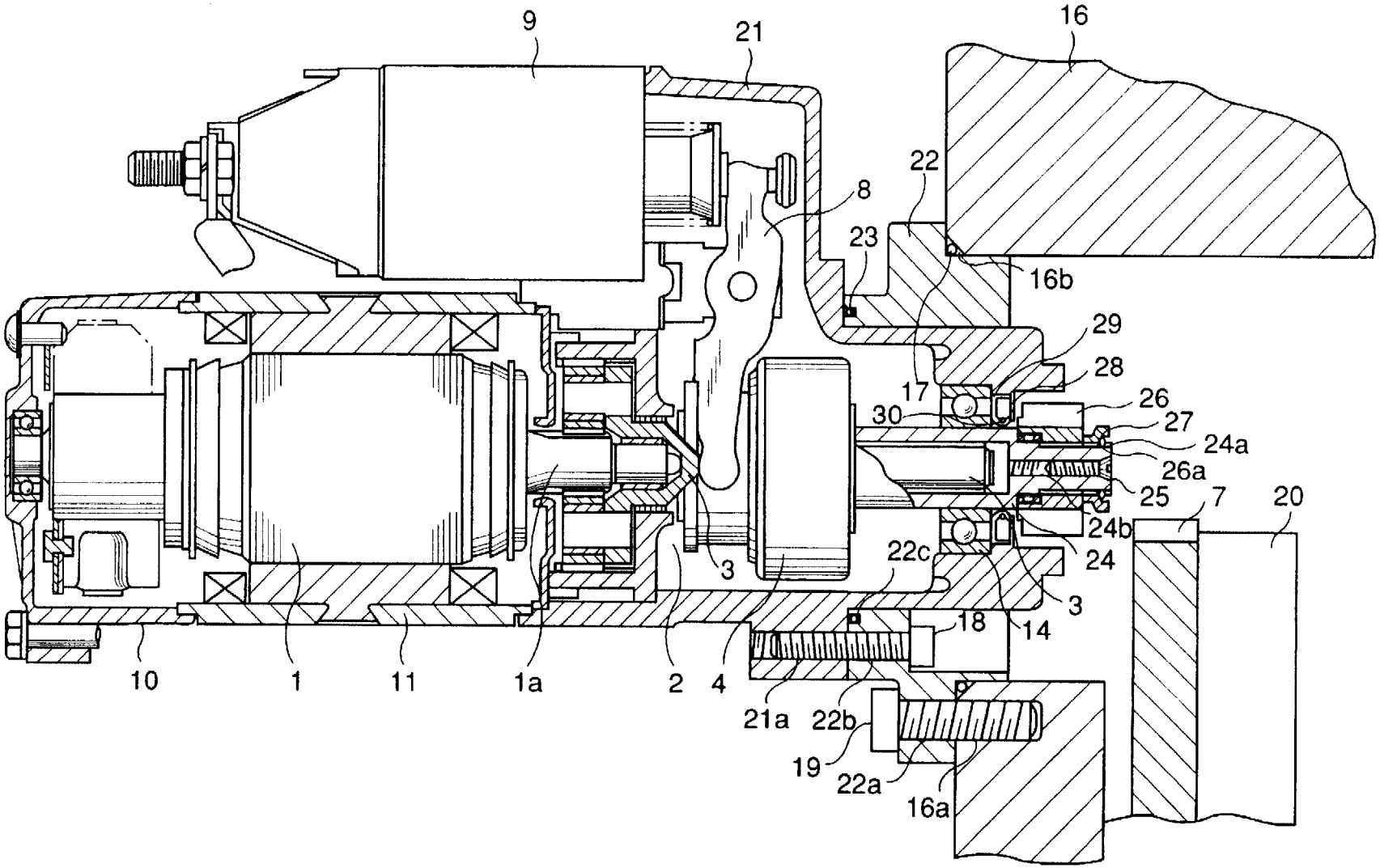
FIG. 3 is a partial sectional view showing a starter apparatus according to a second embodiment of the present invention.
Figure 4:
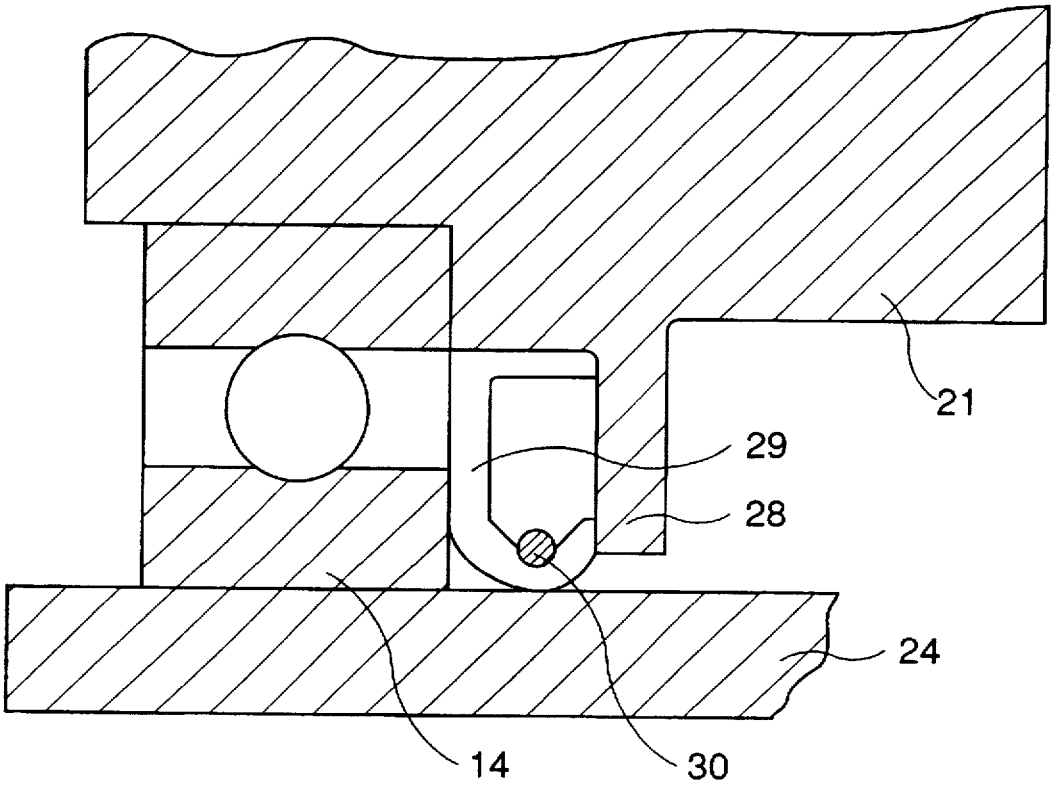
FIG. 4 is a partially enlarged sectional view showing principal portions of the starter apparatus according to the second embodiment of the present invention.

Next, with reference to FIGS. 3 and 4, a second embodiment of the present invention will be described. In FIGS. 3 and 4, reference numeral 24 is a pinion moving member that is integrally formed with a clutch inner of an overrunning clutch 4. Reference numeral 24*a* is a straight spline formed at an edge of an outer peripheral portion of the pinion moving member 24, and 24*b* is an axial screw hole formed in the pinion moving member for receiving a tightening screw 25 that closes a hollow portion of the pinion moving member. Reference numeral 26 is a pinion having a straight spline 26*a* mated with the straight spline 24*a* of the pinion moving member 24. Reference numeral 27 is a stopper for securing the pinion 26, 28 is a ring shaped flange integrally formed on the inner peripheral portion of the front housing 21, and 29 is a C-shaped oil seal disposed between the ball bearing 14 and the flange 28. The oil seal prevents engine oil from leaking out through the ball bearing. Reference numeral 30 is a circular spring disposed in the oil seal 29 for tensioning the inner periphery of the oil seal against the pinion moving member 24.

Since the pinion 26 and the pinion moving member 24 are separately structured, a pinion that has the shape, the number of teeth, and tooth size corresponding to the specifications of the ring gear 7 of the engine can be selected. Thus, with the common front housing 21 and common pinion moving member 24, the starter apparatus according to the second embodiment can satisfy a wide range of mounting conditions.

Moreover, since the C-shaped oil seal 29 with a spring is disposed between the inner periphery of the front housing 21 and the outer periphery of the pinion moving member 24 adjacent the axis of the ball bearing 14, when the starter apparatus is used as a wet type starter, the oil seal and the ball bearing prevent oil of the engine from leaking out to the starter main body. Furthermore, since the oil seal 29 can prevent foreign matter such as dust contained in the engine oil from entering the ball bearing, it can smoothly operate.

Since the flange 28 is integrally formed with the front housing 21 and the oil seal 29 is disposed between the flange and the ball bearing 14, the oil seal can be accurately aligned.

In FIGS. 3 and 4, the oil seal 29 is disposed on the pinion side of the ball bearing 14, but it may instead be disposed on the motor side of the bearing. However, in this case, the dust seal effect of the bearing is deteriorated to some extent.

Third Embodiment

Figure 5:
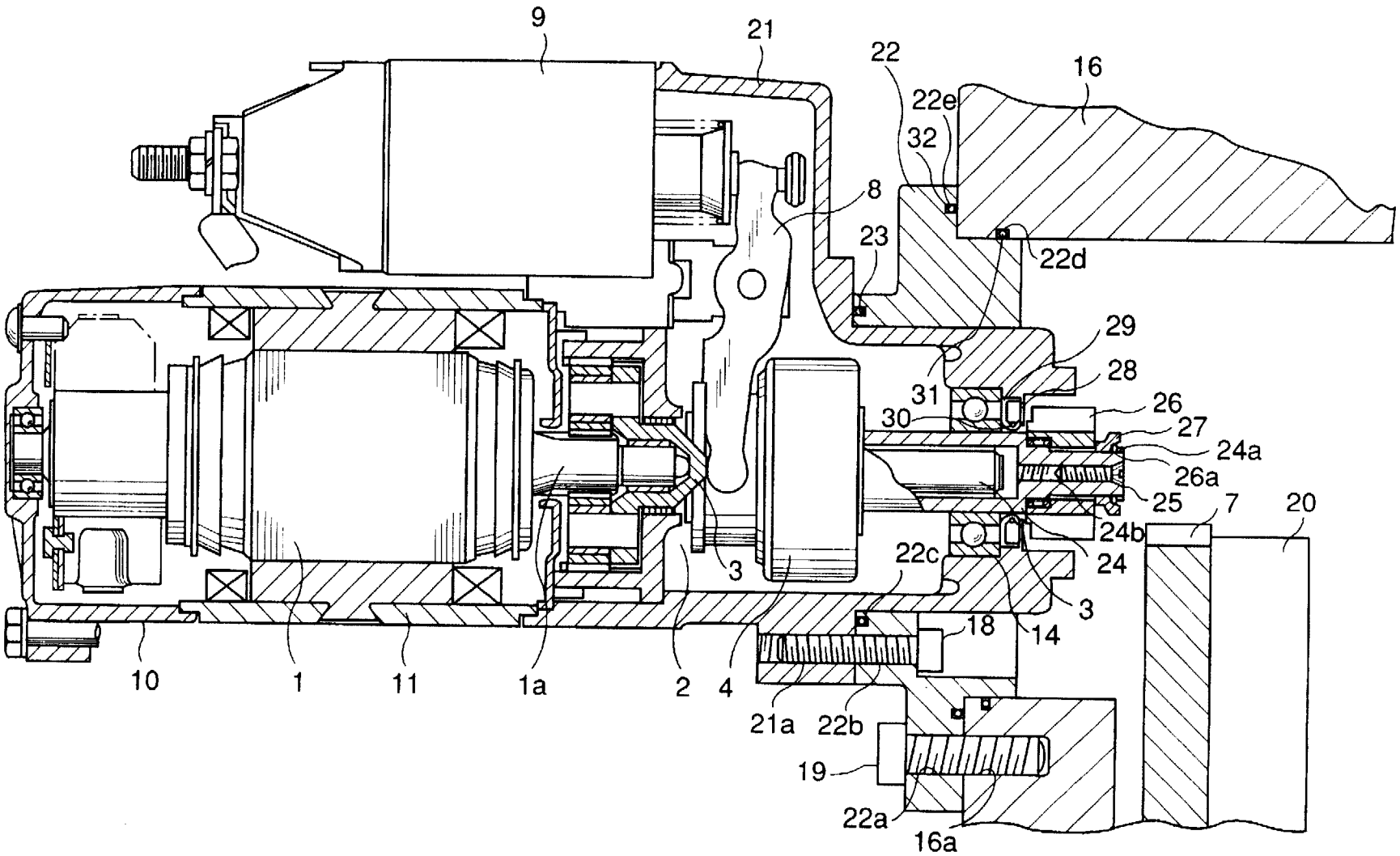
FIG. 5 is a partial sectional view showing a starter apparatus according to a third embodiment of the present invention.

In the first and second embodiments a chamfer 16*b* is formed in the cylinder block 16 on the engine side to accommodate an O ring seal 17. However, the invention is not limited to such a structure. For example, as shown in FIG. 5, circular grooves 22*d* and 22*e* are formed in the flange member 22 to accommodate O rings 31 and 32 which are compressed against the cylinder block 16. Thus, with such a simple structure, oil can be securely prevented from leaking out to the outside of the starter apparatus. When the O ring 31 can securely seal oil, the other O ring 32 may be omitted together with its groove 22*e*.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

What is claimed is:

1. A starter apparatus, comprising:

a) a starter main body having a motor, an output shaft of said motor, a pinion reciprocable in an axial direction of said output shaft and selectively engaging with a ring gear of an engine, an overrunning clutch for transmitting rotation of said output shaft to said pinion, and an overhang type front housing (21) for housing at least said output shaft and said overrunning clutch;

b) a generally circular metal flange member (22) interposed between and rigidly mounted to both said engine and said front housing;

c) a continuous groove (22*c*) defined in the flange member adjacent a mounting surface of the front housing, and d) a sealing ring disposed in the groove and comprised against said mounting surface by the flange member, e) wherein a plurality of selectively alignable screw holes (21*a*, 22*b*, 16*a*) are defined in said front housing, said flange member and said engine such that the starter apparatus may be mounted to the engine via the flange member at a desired rotational angle consistent with structural parameters of the engine and ring gear.

2. The starter apparatus as set forth in claim 1, wherein the front housing is composed of an aluminum material and the flange member is composed of a cast iron material.

3. The starter apparatus as set forth in claim 1, wherein said front housing has a bearing (14) for slidably supporting an outer peripheral portion of a pinion moving member integrally formed with a clutch inner of said overrunning clutch, and an oil seal (29) disposed adjacent to said bearing, and in contact with the outer peripheral portion of said pinion moving member.

4. The starter apparatus as set forth in claim 3, wherein said bearing is a ball bearing and said oil seal is disposed on a pinion side of said ball bearing.

5. The starter apparatus as set forth in claim 1, wherein said flange member has a seal member mounting portion for sealing said engine.

6. The starter apparatus as set forth in claim 1, wherein the number of screw holes in the front housing exceeds the number of screw holes in the engine, and the number of screw holes in the flange member exceeds the number of screw holes in the front housing.

* * * * *